United States Patent [19]

Nunneley

[11] 3,938,549

[45] Feb. 17, 1976

[54] TATTLETALE ANNUCIATOR AND SHUT-DOWN CONTROL FOR COMPRESSORS OR LIKE EQUIPMENT

[75] Inventor: J. David Nunneley, Tulsa, Okla.

[73] Assignee: Frank W. Murphy Manufacturer, Inc., Tulsa, Okla.

[22] Filed: Dec. 16, 1974

[21] Appl. No.: 533,214

[52] U.S. Cl. ..... 137/557; 116/65; 116/70

[51] Int. Cl.[2] ..... G08B 1/04

[58] Field of Search ..... 137/557; 116/65, 70

[56] References Cited

UNITED STATES PATENTS 3,682,129 8/1972 Philbrick ..... 137/557 X

*Primary Examiner*—Henry T. Klinksiek

*Attorney, Agent, or Firm*—D. Paul Weaver

[57] ABSTRACT

A single differential area piston with annunciator flag and coacting malfunction indicia scale is capable of monitoring a relatively large number of malfunction or shut-down points on a compressor or the like. The annunciator piston responds to leakage of an operating fluid medium caused by venting to atmosphere of a particular malfunction sensor on a compressor or like machine with which the annunciator is connected. The annunciator or indicator additionally operates shut-down and start-up control instrumentalities for the monitored machine. A great simplification in tubing, tubing connections and venting means is obtained in comparison to the prior art.

10 Claims, 6 Drawing Figures

TATTLETALE ANNUCIATOR AND SHUT-DOWN CONTROL FOR COMPRESSORS OR LIKE EQUIPMENT

BACKGROUND OF THE INVENTION

Fluid annunciators for monitoring malfunctions in engines, compressors and other machines are known in the prior art including piston-type annunciator devices which monitor plural conditions or functions of the machine and indicate any given malfunction at a shut-down point on the machine. Examples of the patented prior art are U.S. Pat. Nos. 3,682,129 and 3,720,182. The device of the latter patent, which is somewhat typical of the known prior art, requires a separate annunciator device or piston indicator for each malfunction point on a machine being monitored. As a result, the tubing and connections for the operating fluid medium, whether air, gas or liquid, is comparatively complex and costly as is the annunciator mechanism proper. In comparison, the present invention provides a much simpler annunciator and shut-down control of the fluid type for compressors, engines and similar machines, in which a single differential area piston and an associated flag and indicia scale is capable of responding to a relatively large number of malfunction points or sensors on a machine being monitored when any of the sensors vents to the atmosphere and thereby provides a leakage of fluid to which the single piston indicator of the invention responds in a unique way. Up to 10 malfunction points can easily be accommodated by the improved annunciator device.

The annunciator is embodied in a simplified and unitary assemblage which includes a piston chamber having plural leakage ports for connection with malfunction sensors on the machine being monitored. The assembly also possesses a flag chamber having an adjacent indicia window for the mounting of malfunction identification indicia specific to a particular machine function, such as pressure, temperature or liquid level. An annunciator flag moving with the single differential area piston coacts with the indicia means to directly indicate the particular malfunction which resulted in the shut down of the machine. The single piston and flag unit also serves to directly activate a control means for the monitored machine such as a multi-way valve or an equivalent electrical control.

Other features and advantages of the invention will become apparent during the course of the following description.

BRIEF DESCRIPTION OF DRAWING FIGURES

FIG. 1 is a partly schematic view of a fluid annunciator device and shut-down control for compressors, engines or the like.

DETAILED DESCRIPTION

Figure 1:
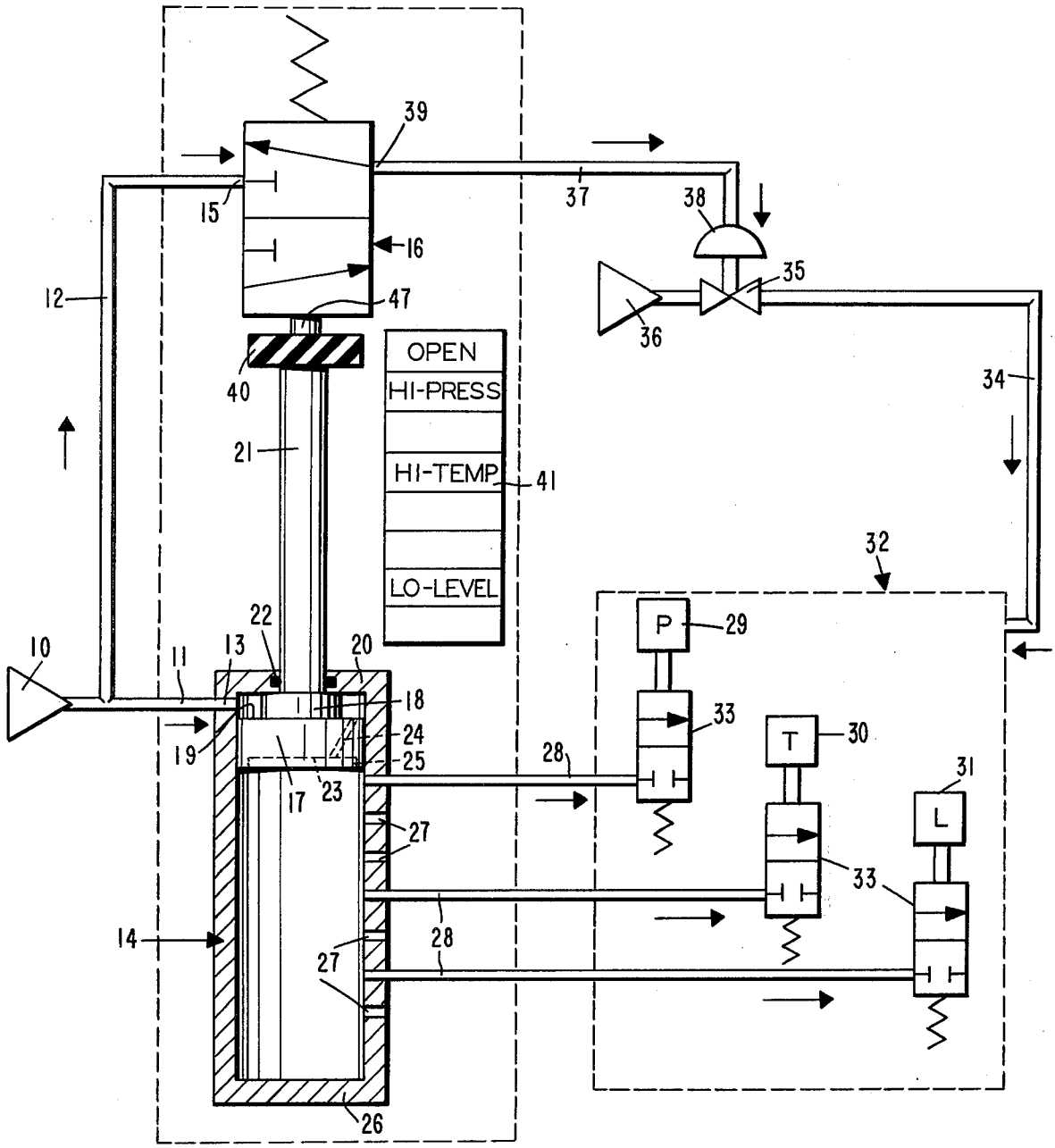

Referring to the drawings in detail wherein like numerals designate like parts, and referring first to FIG. 1, a fluid operating medium which may be air, gas or liquid from a source 10 under suitable pressure, such as 40–80 psi, is delivered simultaneously through conduits 11 and 12 to an inlet port 13 of cylinder body 14 and to the "in" port 15 of a conventional three-way valve 16. As shown in FIG. 1, the fluid medium is blocked at the normally closed in port 15 but enters the cylinder body 14 through the port 13, applying force against the top side of a piston 17 mounted for axial movement in the cylinder body, driving this piston downwardly, as will be further described. The piston has an upper reduced diameter section 18 defining an effective annular marginal working area 19 on the top of the piston 17 exposed to the working fluid entering the chamber from the port 13. The top wall 20 of the cylinder body forms a positive stop to limit upward travel of the piston, and the piston rod 21 is sealed by an O-ring seal 22 where it passes through the end wall 20.

The lower face of piston 17 is recessed centrally at 23, defining a second working face or area on the bottom of the piston which is a somewhat larger area than that defined by the annular face 19. A small port or orifice 24 connects the two working faces 19 and 23, allowing the pressure on the top and bottom of the piston to be equalized at certain times, as will be further described. An annular skirt portion 25 of piston 17 surrounding the recess 23 is adapted to abut the bottom end wall 26 of the cylinder body 14 to positively limit downward movement of the piston in the cylinder.

The side wall of cylinder body 14 has a plurality of longitudinally equidistantly spaced sensing ports 27 formed therethrough for connection with fluid conduits 28 leading to and connecting with a corresponding number of conventional malfunction sensors 29, 30 and 31 on an engine, compressor or like machine 32. The malfunction sensors 29, 30 and 31 are adapted to sense variables such as pressure, temperature and liquid level and the like. Any practical and required number of different malfunction sensors may be accommodated by the sensing ports 27 whose number may be varied in the invention up to about 10 ports in the cylinder body 14. Three such ports 27 are shown in use with three malfunction sensors in the illustrative schematic of the invention in FIG. 1. When conditions of excessive pressure or temperature or low liquid level exist in the machine 32 requiring immediate shut-down thereof, the particular sensor 29, 30 or 31 through its normally closed valve 33 will vent to atmosphere, and this venting will immediately be reflected as a leakage of fluid from cylinder 14 through a particular one of the sensing ports 27, as will be further described.

The machine 32 being monitored, such as a natural gas compressor or an engine, receives gas or fuel for operating through a line 34 from a normally closed two-way diaphragm valve 35 connected with a gas or fuel source 36. Another pressure line 37 communicates with the diaphragm chamber 38 of valve 35 and is also connected with the "out" port 39 of normally closed control valve 16.

The rod 21 of annunciator piston 17 carries a suitable flag 40, such as a colored disc, which passes adjacent to a malfunction indicia scale or panel 41 on a window covering the flag chamber of the apparatus, to be further described. When a particular malfunction occurs in the machine 32 and is sensed by one of the elements 29, 30 or 31, annunciator piston 17 will assume a malfunction indicating position in the bore of cylinder 14 and the flag 40 will stop at a particular indicia or malfunction designation on the panel or chart 41 to indicate a high pressure, high temperature or low level condition, or some other malfunction of the machine requiring immediate shut down. As will be described, the annunciator device in addition to visually indicating a particular one of a number of possible malfunctions of the machine 32 will automatically cause machine shut down and thus the operational capability of the invention is twofold. Additionally, as may now be noted, the invention requires only one annunciator piston and cylinder and one associated flag to monitor quite a large number of variables in a particular machine and this is in contrast with some prior art systems employing separate pistons or like annunciator means for each function or variable being monitored. Such prior art systems are naturally more complicated and costly and also less efficient than the present invention which is characterized by extreme simplicity and compactness.

Figure 5:
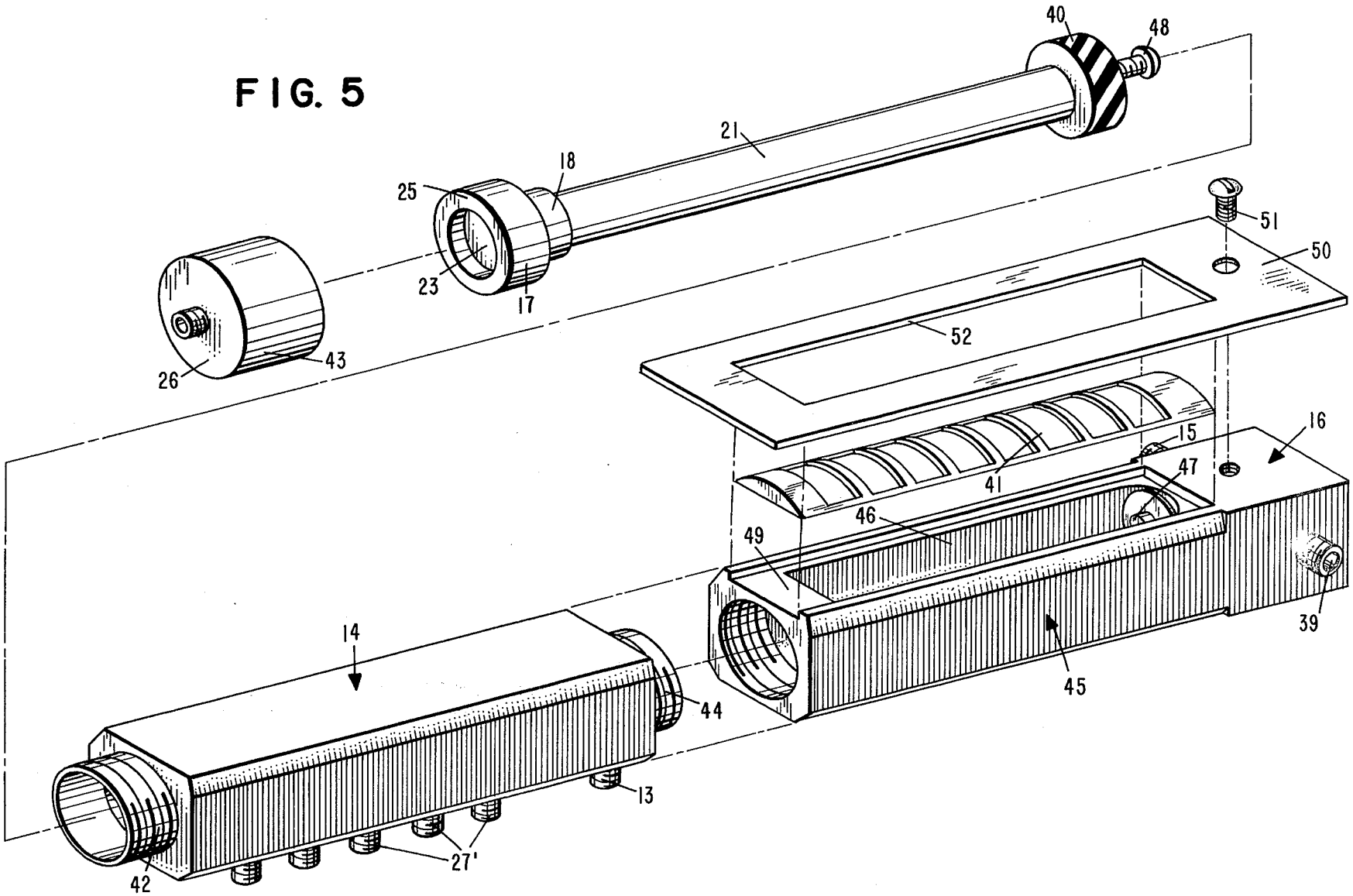
FIG. 5 is an exploded perspective view of the annunciator and control assembly separated from the remainder of the system.

Referring next to FIG. 5, this figure shows the physical components of the annunciator assembly shown somewhat shcematically in FIG. 1. To clarify the structure of the annunciator device or assembly discussed in connection with FIG. 1, it may be explained that the cylinder body 14 for the annunciator piston 17 is embodied in a machine block or body which contains the cylinder bore for the piston. Conveniently, a threaded terminal sleeve 42 on the lower end of body 14 receives a threaded closure cap 43 whose end wall forms the limiting abutment for piston skirt 25, this end wall being previously identified at 26. The previously-described sensing ports 27 are physically embodied in a plurality of threaded openings in the cylinder body 14 which may receive nipples 27' or other suitable fittings which connect with the conduits 28.

Another threaded end terminal 44 of cylinder body 14, or equivalent connecting means, is assembled with a second block-like body portion 45 which has a side opening chamber 46 for the reception therein of the movable flag 40 and piston rod 21. The upper end portion of the element 45 may house the three-way control valve 16 whose port means 15 and 39, previously described, may be embodied in fittings or nipples, or equivalent passage means. An actuator button 47 for valve 16, FIGS. 1 and 5, projects into the top of chamber 46 and is adapted to be contacted by an adjustable screw actuator 48 carried by the rod 21 above the flag 40. This adjustable element 48 is not shown in the schematic of FIG. 1.

The previously noted indicia card or panel 41, which may be a partly transparent element adapted to carry printed strips, is placed in a seat 49 formed at the open side of chamber 46 and is held in place by a suitable cover plate 50 and fastening means 51, the cover plate having a window opening 52. When the parts shown in FIG. 5 in an exploded condition are assembled, the annunciator device is embodied in a highly compact slender elongated assembly which is convenient to handle and install.

Figure 2:
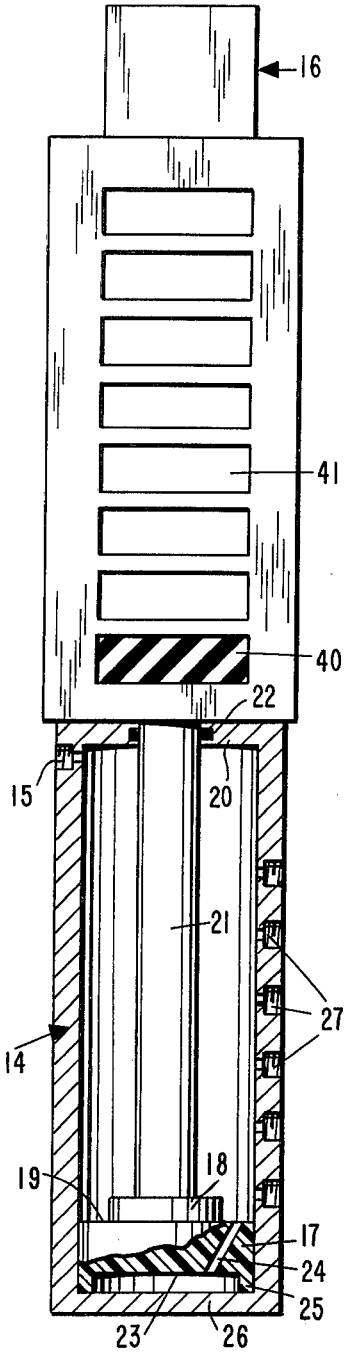
FIGS. 2, 3 and 4 are operational sequence views, partly in cross section, of a differential area piston annunciator device and associated indicia means employed in the invention.
Figure 3:
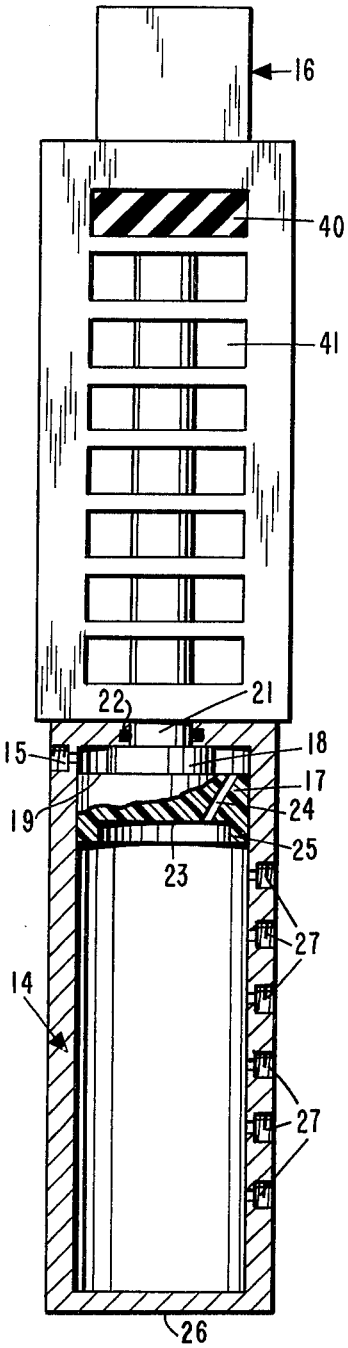
Figure 4:
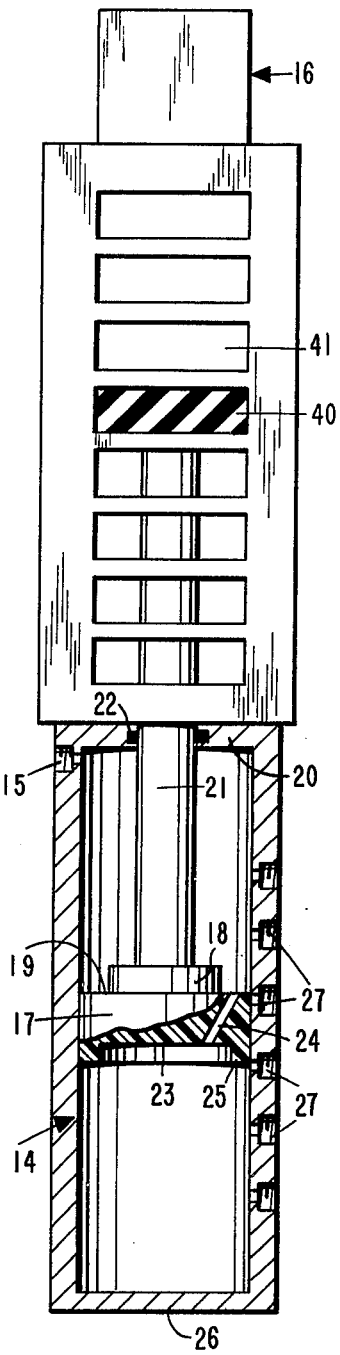

FIGS. 2, 3 and 4, together with FIG. 1, illustrate the operational cycle of the invention, and FIGS. 2, 3 and 4 are also partly schematic in nature. Referring to these figures, when pressurized fluid from the source 10 is delivered to ports 13 and 15 as previously noted, such fluid will be blocked at the normally closed port 15 but will enter the cylinder chamber above piston 17 acting on the top surface 19 and driving the piston and the indicator flag 40 downwardly toward the bottom end wall 26. If all of the sensing ports 27 are blocked or in a non-leaking condition, the piston skirt 25 will bottom against the wall 26 and due to the action of orifice 24, the pressure in the bottom recess 23 and on the top face 19 of the piston will be equalized. When this occurs, piston 17 will move up in the cylinder due to the previously described differential areas on its top and bottom and eventually upward travel of the piston will cease when the element 18 abuts cylinder top wall 20. At this point, the adjustable element 48 on piston rod 21 will have engaged the start button 47 of the integral three-way control valve 16. This conventional valve now operates to place the in port 15 in communication with the out port 39 and the pressure fluid is conveyed through line 37 to the diaphragm chamber 38 of fuel or gas supply valve 35, opening this valve and admitting gas or fuel through line 34 to the machine 32, compressor, engine or the like. This permits the machine to operate in a normal manner.

If any of the malfunction sensors 29, 30, etc., reaches its preset stress point with regard to a variable such as pressure or temperature, it will automatically vent to atmosphere through its valve 33 causing leakage at the particular sensing port 27 with which it is connected. This leakage of pressure below the piston 17 will cause the piston to descend in the cylinder chamber because of the greater fluid pressure now acting on the top of the piston. As illustrated in FIG. 4, the piston will descend until its skirt 25 reaches and partly covers the sensing port 27 where fluid leakage is occurring due to the venting of the associated sensor on the machine 32. The skirt 25 will partially close the sensing port 27 and reduce the vented flow or leakage and the previous balance of forces on the piston 17 will be re-established because a slightly lower-than-normal pressure is being exerted on the larger lower piston face while a higher pressure is being exerted on the slightly smaller top effective face of the piston. When the pressures on the piston are thus balanced, it will be locked at the indicating point relative to the port 27 where leakage is taking place, and the flag 40 will correspondingly be located at the proper point on indicia panel 41 to indicate the nature of the malfunction.

Simultaneously, the element 48 carried by the piston rod 21 above the flag has now moved away from actuator button 47 and the valve 16 returns to its normally closed condition shown in FIG. 1 and pressure fluid flowing to the diaphragm chamber 38 is blocked causing closing of supply valve 35 and shutting down of the machine 32. The piston 17 and flag 40 will remain locked in the indicating position until the system is reset for start up.

Figure 6:
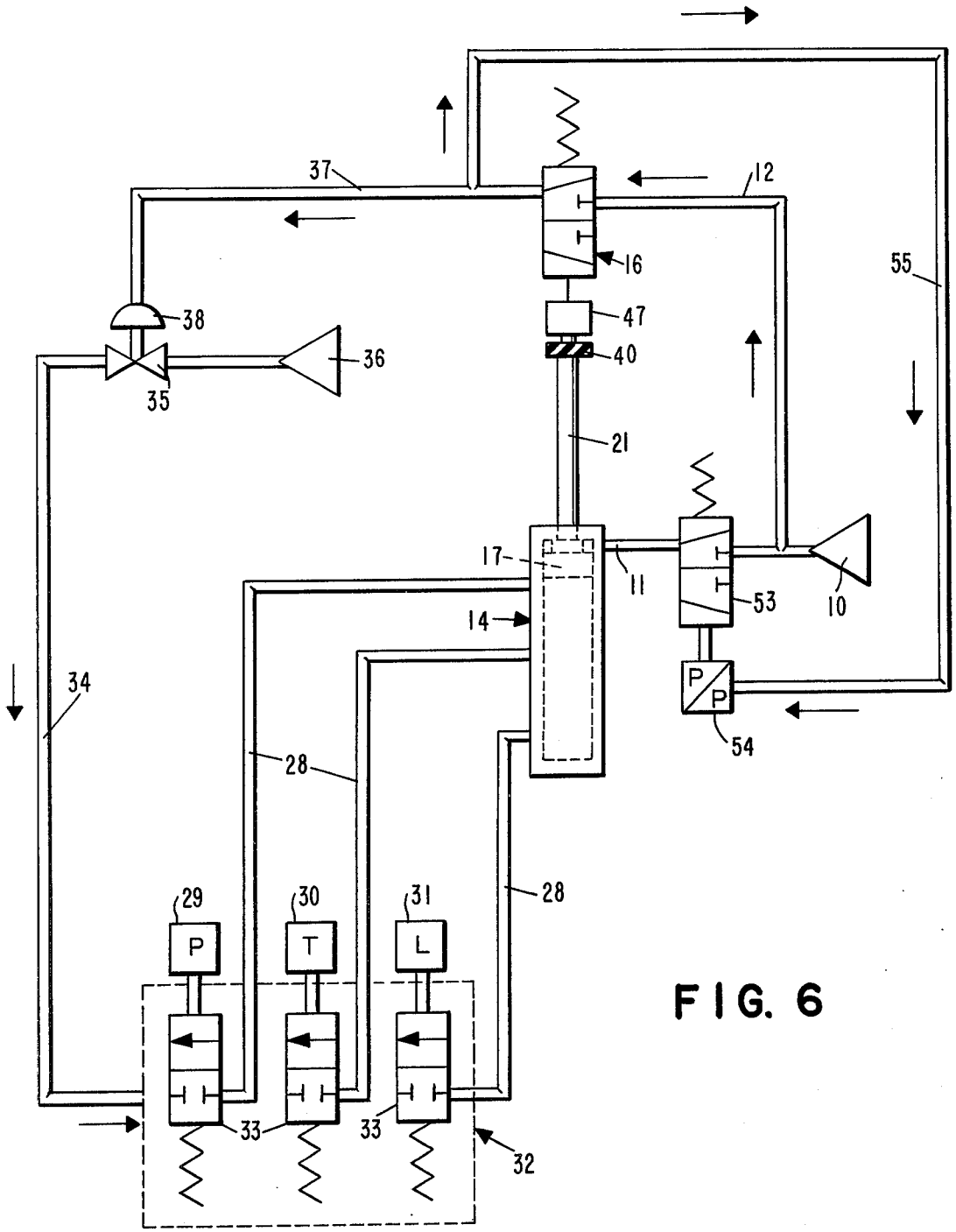
FIG. 6 is a schematic view showing a typical overall system in which the invention is utilized to monitor machine malfunctions and operate associated control or shut-down means.

In this connection, a complete system embodying the invention is shown schematically in FIG. 6 and this system may now be briefly described. A substantial part of the system in FIG. 6 is also shown in FIG. 1 including the monitored machine 32, sensors 29, 30 and 31, fuel supply valve 35, annunciator cylinder 14 with piston 17, and flag 40 and three-way control valve 16 with actuator button 47. FIG. 6 additionally contains a manual and pressure-operated three-way valve 53 including a button 54 which is pushed to start up the system and pulled to achieve a stopped condition. This valve 53 receives working fluid from the source 10 and is connected in the supply conduit 11 leading to the inlet port 13 of cylinder 14. In FIG. 6, the valve 53 is positioned so that the working fluid cannot enter the line 11 leading to the cylinder 14, or is in its normally closed position relative to the cylinder. However, pressurized fluid can enter the line 12 leading to the in port of three-way valve 16 and this valve is also in the normally closed position with no fluid entering the line 37. Therefore, the valve 35 is closed and no gas or fuel is going to the machine, compressor or engine 32.

Additionally, in FIG. 6, a bypass line 55 for working fluid interconnects the line 37 on the down-stream side of valve 16 with the push button 54 in order to supply pressure to hold the start-up valve 53 open during the active cycle of the system. To start up the system, the button 54 is pushed to shift the valve 53 to the open position allowing fluid from the source 10 to pass through line 11 to the inlet port 13 of cylinder 14. The resulting, previously described, movement of the piston 17 will result in opening the valve 16 so that fluid from the line 12 may pass to lines 37 and 55 to enable starting up of the machine 32 by the opening of valve 35 and to maintain the start-up valve 53 open by pressure from the line 55. The operation of the annunciator device forming the main subject matter of the invention and shown particularly in FIG. 1 and FIGS. 2–4 has been described in detail and need not be repeated.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An annunciator and shut-down control for machines equipped with malfunction sensors of the fluid venting type, comprising a cylinder body having a working fluid inlet near one end thereof and plural side wall malfunction sensing ports communicating with the chamber of the cylinder body and adapted for connection with automatic venting means of said malfunction sensors, a piston within the bore of the cylinder body having differential areas on the opposite sides thereof in said bore, said piston having an orifice communicating with said differential areas whereby fluid pressure on opposite sides of the piston in said bore may be equalized, a piston rod secured to the piston and extending beyond one end of the cylinder body and having a position indicator secured thereto for movement therewith, a malfunction indicia means positioned near said rod and indicator and cooperating with the indicator when the piston is stopped in said bore at a particular malfunction indicating position to indicate directly the nature of the malfunction and where located relative to the cylinder body and said sensing ports, a machine start-up and shut-down control valve including an actuator button located in the path of movement of said piston rod and adapted to be engaged by the latter, said control valve having in and out ports for connection respectively with a working fluid supply and a conduit leading to a supply valve for a machine being monitored, said working fluid inlet of the cylinder body adapted for connection with said working fluid supply.

2. The apparatus of claim 1, wherein said malfunction sensing ports are spatially arranged relative to indicia components on said malfunction indicia means so that a particular indicating position of said piston and position indicator will faithfully indicate a correctly corresponding indicia component on said malfunction indicia means.

3. The apparatus of claim 1, and said cylinder body including end walls forming limit stops for said piston, one side of said piston having a central projection adapted to abut one of said end walls to limit movement of the piston in one direction and the other side of said piston having a recess which defines a marginal piston skirt adapted to abut the other end wall of the cylinder body, the effective area on said one side of the piston surrounding said projection being slightly smaller than the effective area at the other side of said piston defined by said recess, and said piston orifice interconnecting said differential effective areas.

4. The apparatus of claim 3, and said marginal piston skirt adapted to automatically seek out one of said side wall sensing ports through which fluid leakage from the bore of the cylinder body is occurring responsive to the venting of a machine malfunction sensor and partially interrupting such leakage to an extent that a temporary unbalance of fluid pressure on the differential areas at the opposite sides of said piston is corrected and equalized to lock the piston and said position indicator at a given indicating position.

5. The apparatus of claim 4, and a manual reset means having a fluid connection with said working fluid inlet of the cylinder body and operable to release said piston from a fluid pressure locked position in said cylinder bore.

6. The apparatus of claim 1, and said position indicator on said piston rod comprising a visual indicator disc adapted for alignment with spaced indicia portions of the malfunction indicia means.

7. The apparatus of claim 6, and a housing body portion secured to the cylinder body and having a chamber receiving said piston rod and position indicator movably, said chamber having an open side, and said malfunction indicia means comprising an indicia panel mounted on said housing body portion in covering relation to said chamber open side, the cylinder body and housing body portion forming an assembled unit.

8. The apparatus of claim 7, and said machine control valve mounted on the housing body portion with said valve actuator button projecting into one end of said chamber of the housing body portion in the path of movement of the piston rod.

9. The apparatus of claim 8, and an adjustable actuator element on the leading end of the piston rod adapted to contact said control valve actuator button during extension of the piston rod in the chamber of the housing body portion.

10. The apparatus of claim 9, and separable means to couple said cylinder body in assembled relationship with the housing body portion and with the bore of the cylinder body coaxial with said body portion chamber receiving said piston rod and position indicator.

* * * * *